US005381602A

United States Patent [19]

Matzo et al.

[11] Patent Number: 5,381,602

[45] Date of Patent: Jan. 17, 1995

[54] ELECTRIC MOTOR OPERATED HAND CIRCULAR SAW

[75] Inventors: David Matzo, Leinfelden-Echterdingen; Eduard Gansel, Dettenhausen; Heribert Schramm, Stuttgart, all of Germany

[73] Assignee: Robert Bosch GmbH, Stuttgart, Germany

[21] Appl. No.: 134,176

[22] Filed: Oct. 8, 1993

[30] Foreign Application Priority Data

Nov. 19, 1992 [DE] Germany ..... 4238936

[51] Int. Cl.[6] ..... B27B 9/02

[52] U.S. Cl. ..... 30/377; 30/375

[58] Field of Search ..... 30/373, 374, 375, 376, 30/377

[56] References Cited

U.S. PATENT DOCUMENTS

| | | | |
|---|---|---|---|
| 1,623,290 | 4/1927 | Wappat | 30/377 |
| 1,740,074 | 12/1929 | Crowe | 30/377 |
| 3,262,471 | 7/1966 | McCarty | 30/377 |
| 4,221,051 | 9/1980 | Glass | 30/377 |
| 4,982,501 | 1/1991 | Sauerwein et al. | 30/377 |
| 5,010,651 | 4/1991 | Techter et al. | 30/376 |

FOREIGN PATENT DOCUMENTS 4001331 7/1991 Germany .

*Primary Examiner*—Richard K. Seidel
*Assistant Examiner*—Hwei-Siu Payer
*Attorney, Agent, or Firm*—Michael J. Striker

[57] ABSTRACT

An electric motor operated hand circular saw has a base plate, a motor housing turnable relative to the base plate, an electric motor accommodated in the motor housing and having a drive shaft, a circular saw blade arranged on the drive shaft of the electric motor, and a pre-slitting abutment for adjusting a pre-slitting position of the saw blade in which the saw blade penetrates into a surface of a workpiece to be sawed by a limited pre-slitting depth. The pre-slitting abutment has two fixed abutment positions in which two different turning positions of the motor housing relative to the base plate are adjusted, so that in a first of the abutment positions during guiding the base plate over a guiding rail on a workpiece surface and in a second of the abutment positions during guiding the base plate along a strip clamped on the workpiece surface or with a parallel abutment held on the base plate on the workpiece edge on the workpiece surface, the saw blade penetrates correspondingly into the workpiece surface with a pro-slitting depth.

13 Claims, 3 Drawing Sheets

ELECTRIC MOTOR OPERATED HAND CIRCULAR SAW

BACKGROUND OF THE INVENTION

The present invention relates to an electric motor operated hand circular saw. In particular, it relates to a hand circular saw which has a base plate and a motor housing turnable relative to the base plate and accommodating an electric motor which has; a drive shaft supporting a circular saw blade, and a pre-slitting abutment for adjusting a pre-slitting position of the saw blade.

Pre-slitting abutments on the hand circular saws serve to prevent a tearing off of the cover layer during pre-slitting in the process of separation of plate-shaped workpieces of wood or the like with a cover sheet composed of synthetic plastic, hard paper and the like, such as, for example, melanine-coated and veneered plates, plywood plates, wood core plywood, etc. The pre-slitting abutment adjusts the insertion depths of the saw blade into the surface of the workpiece by approximately 1–2 mm., so that in a first working step, only the surface is slitted and, for example, only the cover layer is separated, while in the subsequent sawing step in which the insertion depth of the saw blade is substantially 5 mm. greater than the workpiece thickness, the workpiece can be separated without any tearing off.

In a known hand circular saw of the above-mentioned type disclosed in the German document DE 40 01 331 A1, the pre-slitting abutment is formed as a turning lever which is turnable on the saw blade protective hood fixedly connected with the base plate and is limitedly adjustable in a vertical direction in a longitudinal hole. It is pulled by a pulling screen mounted on the protective hood in the direction of the protective hood, until it abuts against an abutment provided there. An abutment element is connected with the motor housing and during insertion of the saw blade in its pre-slitting position, abuts against an abutment projection of the turning lever. After performing the pre-slitting step, the turning lever is turned against the restoring force of the pulling spring and the motor housing of the saw blade can be turned to a desired cutting depth. A presumption for performing the pre-slitting step is, however, the use of a guiding rail with a sliding shoe mounted on the base plate and sliding on a guiding rib which projects over the guiding rail fixedly clamped on the surface of the workpiece.

SUMMARY OF THE INVENTION

Accordingly, it is an object of the present invention to provide an electric motor driven hand circular saw which avoids the disadvantages of the prior art.

In keeping with these objects and with others which will become apparent hereinafter, one feature of the present invention resides, briefly stated, in an electric motor driven hand circular saw, in which the pre-slitting abutment has two fixed abutment positions for adjusting two different turning positions of the motor housing relative to the base plate, and the abutment positions are adjusted so that in the first abutment position during guiding of the base plate, preferably with the slide shoe formed on it, over a guiding rail on the workpiece surface, and in the second abutment position, during guiding the base plate especially along a strip clamped on the workpiece surface or with a parallel abutment held on the base plate on the workpiece surface, the saw blade correspondingly is inserted with a pre-slitting depth into the workpiece surface.

When the electric motor operated hand circular saw is designed in accordance with the present invention, a pre-slitting process is possible with the reliably properly adjusted pre-slitting depth of the saw blade both during operation with a guiding rail and sliding shoe and also during the operation with a parallel abutment or in absence of such a strip clamped with the workpiece surface.

In both cases, by adjusting one or another abutment position of the pre-slitting abutment, the insertion depths of the saw blade into the workpiece surface is fixedly provided with a desired value.

In accordance with a preferable embodiment of the invention, the pre-slitting abutment has a cutting depth ruler mounted at one end side of the base plate. It is provided with a guiding slot which extends over the turning angle of the motor housing and a clamping element fixed on the motor housing and extending through the guiding slot so as to be clamped on the cutting depth ruler. Two abutment projections are formed on the clamping element. The first abutment projection abuts in the first abutment position of the pre-slitting abutment and the second abutment projection abuts in the second abutment position of the pre-slitting abutment against the end of the guiding slot facing away from the base plate. The first abutment projection is liftable from the guiding slot.

With this construction the pre-slitting abutment can be simultaneously combined with the depth abutment which is conventional in hand circular saws for adjusting the cutting depth of the saw blade. Therefore a cost-favorable design of the pre-slitting abutment and the depth abutment is provided.

Outside of the abutment positions of the pre-slitting abutment, any turning positions of the motor housing relative to the base plate over an available turning region and thereby each desired cutting depth within a predetermined cutting depth region of the saw blade can be selected. They can be fixedly adjusted by clamping the clamping element on the cutting depth ruler for each working process.

In accordance with a further advantageous feature of the present invention, a structurally simple realization of the clamping element with the abutment projections can be obtained when the clamping element has a guiding sleeve inserting at the end side into the guiding slot of the cutting depth ruler, a clamping screw which releasably clamps the guiding sleeve on the cutting depth ruler, and a beam axially displaceable on the guiding sleeve and extending back from the guiding sleeve in the longitudinal direction of the cutting depth ruler. Due to the axial displaceability of the beam on the guiding sleeve, it can be selectively inserted into the guiding slot and removed from the guiding slot. The free end of the beam forms the first abutment projection and the insertion end of the guiding sleeve forms the second abutment projection.

In accordance with another embodiment of the present invention, the beam can be formed on a displacement sleeve which is seated on the guiding sleeve and is supported via a pressure spring on the guiding sleeve near its end which is opposite to the insertion end. The pressure spring holds the beam in engagement with the guiding slot in the cutting depth ruler. By lifting the displacement sleeve against the spring force of the pressure spring, the beam can be lifted from the guiding slot and placed by turning the displacement sleeve onto the clamping rail, so that after releasing of the displacement sleeve it is not inserted again in the guiding slot. The second abutment projection formed by the insertion end of the guiding sleeve is released and can be displaced to the upper end of the guiding slot.

In accordance with an advantageous embodiment of the present invention, the clamping screw has a screw shaft fixed on the motor housing and provided with a threaded portion at least on its free end and a wing nut screwed on the threaded portion. The guiding sleeve sits on the screw shaft and the wing nut is supported through the pressure spring on the guiding sleeve. The pressure spring prevents lifting of the guiding sleeve from the guiding slot during releasing of the wing nut for displacement of the clamping element in the guiding slot.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
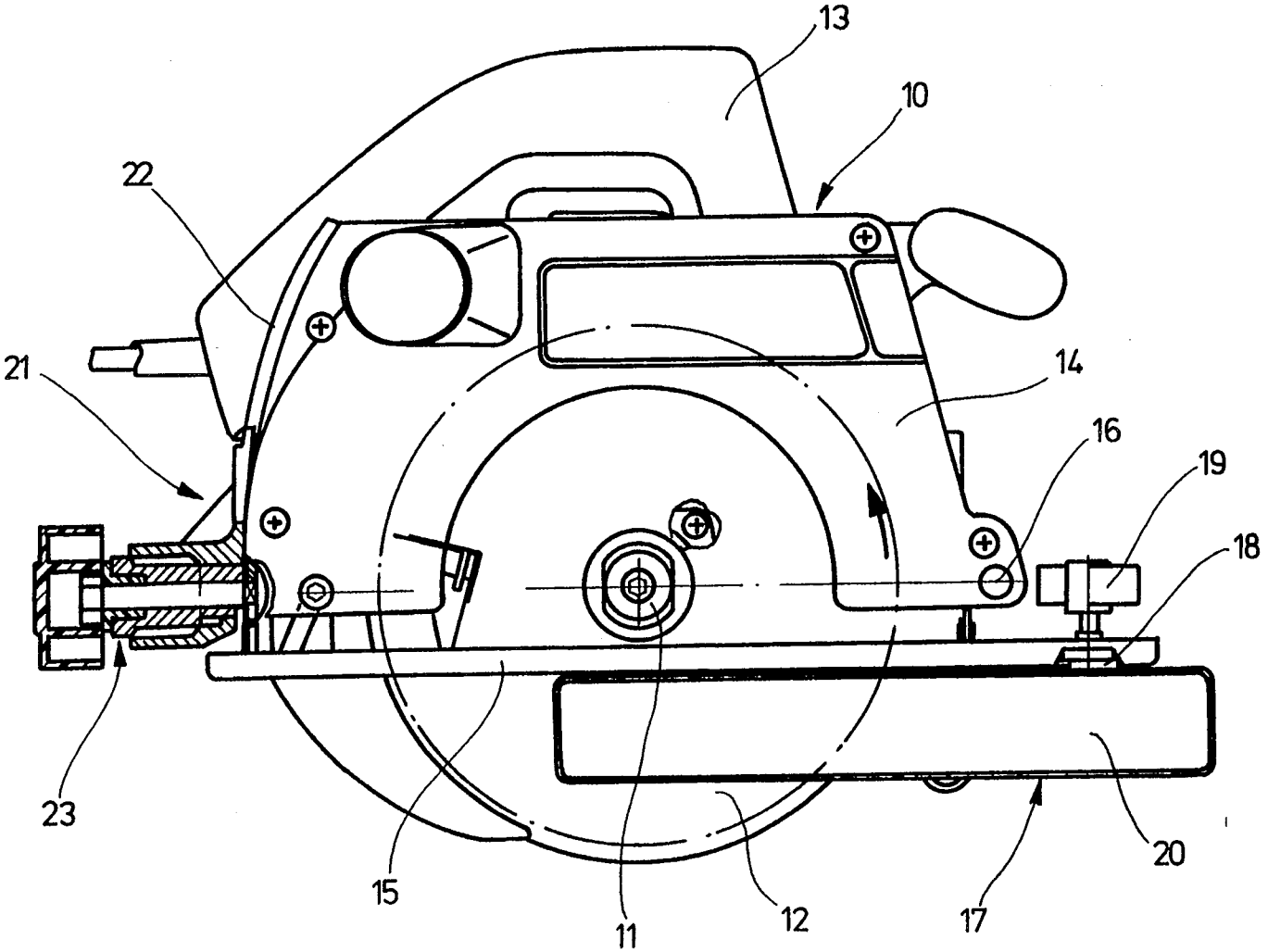
FIG. 1 is a side view of an electric motor operated hand circular saw.

An electric hand circular saw shown in FIG. 1 has a motor housing 10 which accommodates an electric motor. A circular saw blade 12 is mounted on a drive shaft 11 of the electric motor for joint rotation therewith. A handle 13 and a protective hood 14 are integrally formed on the motor housing 10. The protective hood overlaps the circular saw blade 12 in its upper region over approximately 180°.

The motor housing 10 is turnably mounted on a base plate 15 at a distance from the drive shaft 11 of the electric motor. The turning point is identified with reference numeral 16. The base plate serves for guiding the hand circular saw on the surface of the workpiece to be sawed. A parallel abutment 17 adjustably mounted on the base plate 15 serves for rectilinear guidance of the base plate 15 and thereby the circular saw on the workpiece edge. The known parallel abutment 17 has a rail 18 provided with a scale and extending parallel to the drive shaft 11. It is axially displaceable in guides on the base plate 15 and is fixable by adjusting screw 19 in each displacement position. At the end of the rail 18 a guiding sheet 20 is mounted at a right angle. It extends parallel to the base plate 18 and downwardly from it and during the operation is longitudinally guided on a longitudinal edge of the workpiece to be sawed. The base plate 15 is provided with a not-shown sliding shoe with a longitudinal axis extending parallel to the circular saw blade 12. The sliding shoe can be formed for example as a separate part connected with the base plate 15, as disclosed in the German document DE 40 01 33 A1. However, it can also be formed by a longitudinally extending angle bend in the base plate. During the sawing process a guiding rail is utilized in a known manner. It is clamped to the upper surface of the workpiece to be sawed and carries a guiding ring projecting over the rail for placing the sliding shoe and moving the same during the sawing process.

A pre-slitting abutment 21 is arranged at an end side of the protective hood 14 which is diametrically opposite to the turning point 16 with respect to the drive shaft 11. It is combined with a depth abutment. The pre-slitting abutment 21 includes a cutting depth ruler 22 mounted at one end of the ground plate 15 and a clamping element 23 cooperating with the cutting depth ruler 22 and fixed on the protective hood 14. The cutting depth ruler 22 is arcuate, and the central curvature is located in the turning point 16 of the base plate 15 and the motor housing 10 and extends from the base plate 15 along the end side of the protective hood 14. As can be seen from FIGS. 4 and 5, the cutting depth ruler 22 is provided with an axially extending guiding slot 24. The slot is closed at one end side and its length determines the turning region of the motor housing 10 around the turning point 16 of the base plate 15. The clamping element 23 in the protective hood 14 engages through the guiding slot 24 and can be clamped on the cutting depth ruler 22. Therefore the relative turning position of the motor housing 10 to the base plate 15 is fixed.

Figure 2:
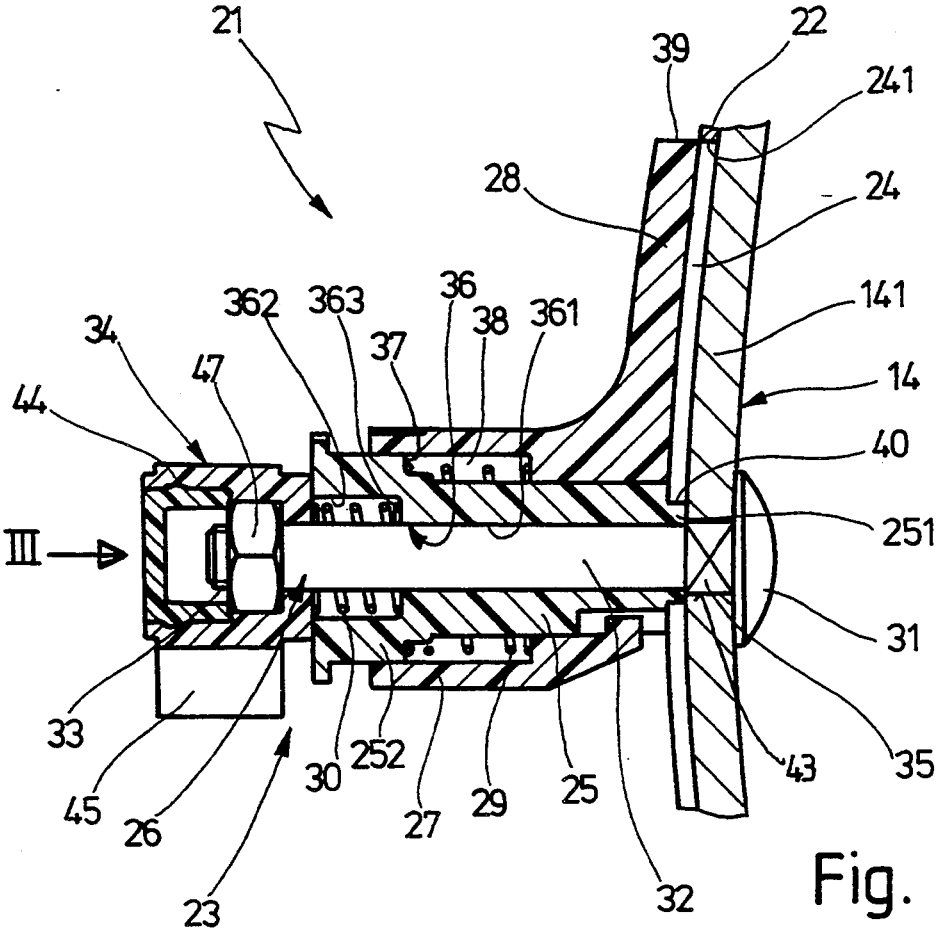
FIG. 2 is a view showing a longitudinal section of a pre-slitting abutment of the hand circular saw of FIG. 1, on an enlarged scale.
Figure 3:
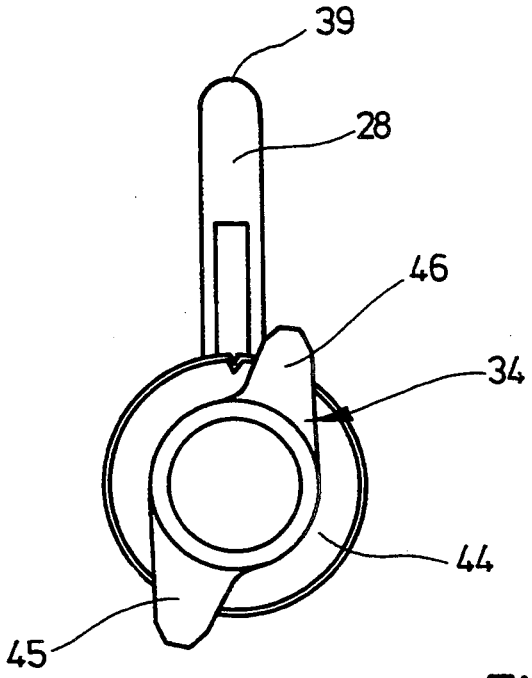
FIG. 3 is a view of the pre-slitting abutment in the direction of the arrow III in FIG. 2.

As shown in FIG. 2 on an enlarged scale, the clamping element 23 has a guiding sleeve 25, a clamping screw 26, a displacement sleeve 27, a beam 28 and two pressure springs 29 and 30. The clamping screw 26 is a head screw with a flat head 31 and a threaded shaft 32 which carries at one end side a threaded portion 33 for screwing a wing nut 34. A shaft portion 35 is provided with a substantially square cross-section directly at the flat head 31. This shaft portion 35 extends in a form-locking manner through an opening 43 in the wall 141 of the protective hood 14 having also a square cross-section. Therefore, the screw shaft 32 is secured against rotation during screwing of the wing nut 34. The flat head 31 abuts with its lower side against the inner surface of the wall 141 of the protective hood 14.

The guiding sleeve 25 composed of a synthetic plastic has a stepped opening 36 with an opening portion 361 having a smaller diameter and an opening portion 362 having a greater diameter. The guiding sleeve 25 is guided on the screw shaft 32 with the opening portion 361. At the end which faces the cutting depth ruler 22, the outer diameter of the guiding sleeve 25 is reduced to the width of the guiding slot 24 in the cutting depth ruler 22. Therefore, a guiding pin 251 is produced, which engages in the guiding slot 24 of the cutting depth ruler 22 and extends to the protective hood wall 141. With the guiding pin 251, the guiding sleeve 25 during displacement along the cutting depth ruler 22 is guided in the guiding slot 24 substantially without play. At the sleeve end which faces away from the guiding pin 251, a radially projecting ring collar 252 is formed on the guiding sleeve 25. Its lower ring surface which faces toward the cutting depth ruler 22 forms an abutment surface 37 for the first pressure spring 29. The opening portion 362 has a greater diameter in the region of the ring collar 252. The second pressure spring 30 is inserted in this opening portion 362 and coaxially surrounds the screw shallot 32. The second pressure spring 30 is supported against a ring shoulder 363 formed at the transition between the opening portions 361 and 362 and against the wing nut 34. The wing nut 34 is composed of a synthetic plastic cap 44 with two turning wings 45 and 46 which are formed integrally, and of a nut 47 which is received in the synthetic plastic cap 44 for joint rotation with it.

The displacement sleeve 27 which is also composed of synthetic plastic sits together with the integrally formed beam 28, on the guiding sleeve 25 axially displaceably and rotatably. A first pressure spring 29 is received in an increased recess 38 of the displacement sleeve 27 and abuts against the supporting surface 37 on the guiding sleeve 25 and the base of the recess 38, and therefore the displacement sleeve 27 is tensioned in the direction of the cutting depth ruler 22. The beam 28 extends at a right angle back from the displacement sleeve 27 in the longitudinal direction of the cutting depth ruler 22. Its width is insignificantly smaller than the width of the guiding slot 24, so that the beam 28 can engage in the guiding slot 24 while the end of the displacement sleeve 27 is placed on the clamping rail.

Figure 4:
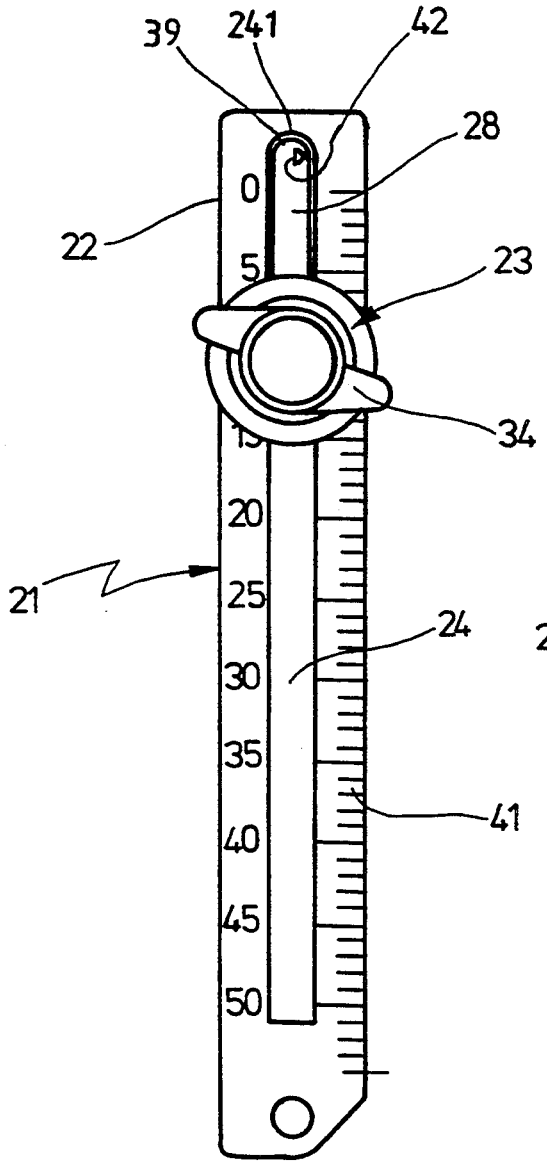
FIGS. 4 and 5 each represent a plan view of the pre-slitting abutment in two different abutment positions for the pre-slitting process.
Figure 5:
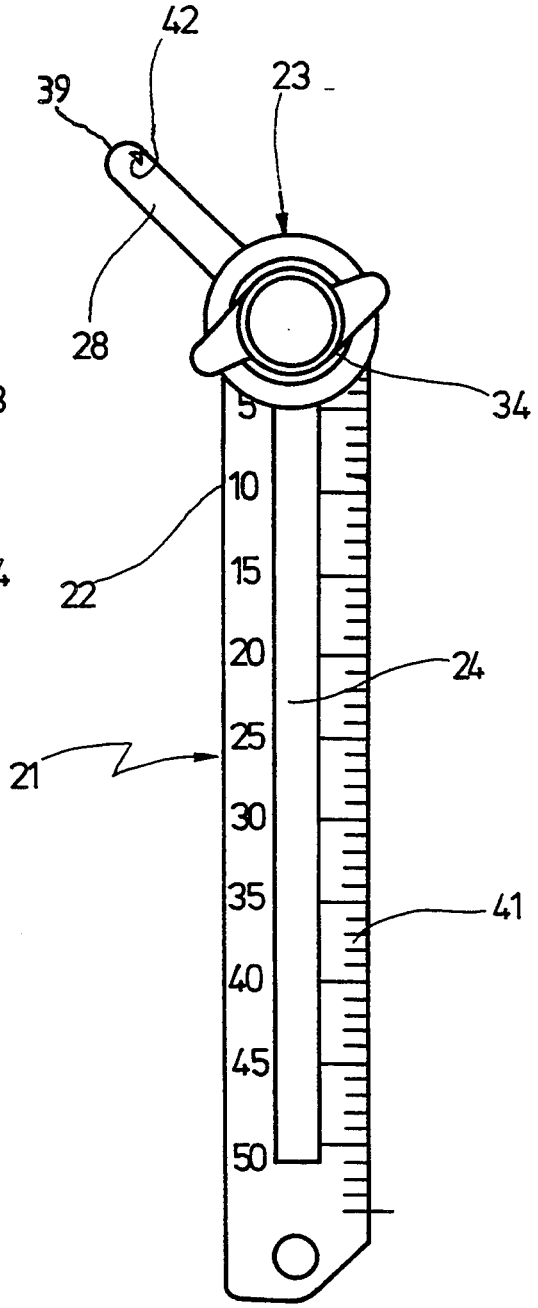

The free end of the beam 28 forms a first abutment projection 39 cooperating with the upper end 241 of the guiding slot 24. The guiding pin 251 of the guiding sleeve 25 forms a second abutment projection 40 which also cooperates with the upper end 241 of the guiding slot 24. Both abutment projections 39 and 40 in their abutment positions on the upper end 241 of the guiding slot 24 guarantee one of two abutment positions of the pre-slitting abutment 21 in which the saw blade 12 is adjusted always to the predetermined pre-slitting depth when the hand circular saw in connection with different auxiliary means is operated in this way with the parallel abutment or with the guiding rail with sliding shoe. When the base plate 15 with the sliding shoe is guided on a guiding rail, the pre-slitting abutment 21 is adjusted so that the abutment projection 39 on the beam 28 is effective and abuts against the upper end 241 of the guiding slot 24 as shown in FIG. 4. In this position the slitting-in depth of the saw blade 12 in the workpiece surface corresponds to the predetermined pre-slitting depth of 1–2 mm. When the hand circular saw must be guided with the parallel abutment 17, then by lifting the displacement sleeve 27 against the restoring force of the pressure spring 29, the beam 28 is lifted from the guiding slot 24. Now the pre-slitting abutment 21 can be adjusted so that the abutment projection 40 on the guiding beam 251 of the guiding sleeve 25 is effective and abuts against the upper end 241 of the guiding slot 24 as shown in FIG. 5. In this position, the saw blade 12 projects with the required pre-slitting depth of 1–2 mm. over the base plate 15 and, since the base plate 15 directly abuts against the workpiece surface, the saw blade 12 pre-slits the surface of the workpiece in the same pre-slitting depth of 1–2 mm. For converting of the pre-slitting abutment 21 from one abutment position to another abutment position, the wing nut 34 must be released and again tensioned, so that the guiding sleeve 25 is clamped in the corresponding position again on the cutting depth ruler 22. During displacement of the guiding sleeve 25 after loosening of the wing nut 34, the pressure spring 30 retains the guiding pin 251 on the guiding sleeve 25 in the guiding slot 24 so that it is not removed from the latter.

For providing the cutting depth adjustment of the saw blade 12, a scale 41 is provided along the guiding slot 24 on the cutting depth ruler 22 and a mark 42 is arranged correspondingly on the beam 28 and the displacement sleeve 27. The mark on the displacement sleeve 27 is not seen in the drawing when the mark 42 on the beam 28 is adjusted by displacement of the clamping element 23 to a predetermined value, the saw blade 12 automatically is inserted during operation with the guiding rail into the workpiece by the adjusted cutting depth. When the mark is adjusted on the displacement sleeve 27 by displacement with a predetermined value, the saw blade during the operation with the parallel abutment 17 automatically projects by the adjusted cutting depth over the base plate 15.

When, for example, a melanine coated board with the thickness of 19 mm. must be sawed through without tearing off, and near the hand circular saw a guiding rail with a sliding shoe is available, the pre-slitting abutment 21 is transferred to the abutment position shown in FIG. 4. Then the first sawing step, so-called pre-slitting, is performed in which the melanine covered layer with a depth of 1–2 mm. is slit. After this pre-slitting step, the wing nut 34 is released and the cutting depth is adjusted so that the mark 42 on the beam 28 points to the scale line "19". Now the board is sawed through completely and without tearing off, and the saw blade 12 extends with the through-cut approximately 5 mm. under the sawed board.

When for the saw only the parallel abutment 17 is available, the pre-slitting abutment 21 is transferred to its abutment position shown in FIG. 5. For this purpose the wing nut 34 is loosened and the displacement sleeve 26 is drawn upwardly so that the beam 28 is removed from the guiding slot 24. The clamping element 23 is displaced so that it abuts up to the guiding pin 251 at the upper end 241 of the guiding slot 24. The wing nut 34 is again tensioned. The pre-slitting step can be performed, and again the melanine covering layer is slit with a depth of 1–2 mm. For performing the subsequent sawing process, the wing nut 34 is again released, the displacement sleeve 27 is lifted and the guiding sleeve 25 is displaced into the guiding slot 24 so that the beam 28 after the release of the guiding sleeve 27 can be again inserted into the guiding slot 24. Then the clamping element 23 is displaced so far until the mark on the displacement sleeve 27 points to the scale line 19. The wing nut 34 is again tightened. During the sawing step, the board is completely sawed through, and the saw blade 12 extends approximately 5 mm. under the sawed board.

It will be understood that each of the elements described above, or two or more together, may also find a useful application in other types of constructions differing from the types described above.

While the invention has been illustrated and described as embodied in an electric motor operated hand circular saw, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An electric motor operated hand circular saw, comprising a base plate; a motor housing turnable relative to said base plate; an electric motor accommodated in said motor housing and having a drive shaft; a circular saw blade arranged on said drive shaft of said electric motor; and a pre-slitting abutment for adjusting a pre-slitting position of said saw blade in which said saw blade penetrates into a surface of a workpiece to be sawed by a limited pre-slitting depth, said pre-slitting abutment having two fixed abutment positions in which two different turning positions of said motor housing relative to said base plate are adjusted, so that in a first of said abutment positions during guiding said base plate over a guiding rail on a workpiece surface and in a second of said abutment positions during guiding said base plate along a strip clamped on the workpiece surface or with a parallel abutment held on said base plate on the workpiece edge on the workpiece surface, said saw blade penetrates correspondingly into the workpiece surface with a pre-slitting depth, said pre-slitting abutment has a cutting depth ruler mounted on said base plate and provided with a guiding slot extending over a turning region of said motor housing, and a clamping element fixed on said motor housing so that said clamping element extends through said guiding slot and is clampable on said cutting depth ruler, said clamping element having two abutment projections formed so that a first one of said abutment projections in said first abutment position of said pre-slitting abutment and a second one of said abutment projections in said second abutment position of said pre-slitting abutment abuts correspondingly against an end of said guiding slot which faces away from said base plate, and said first abutment projection is liftable from said guiding slot.

2. A saw as defined in claim 1, wherein said clamping element has a guiding sleeve inserted in said guiding slot of said cutting depth ruler, a clamping screw which clamps said guiding sleeve releasably on said cutting depth ruler, and a beam which is at least axially displaceable on said guiding sleeve and extending from the latter in a longitudinal direction of said cutting depth ruler and also selectively insertable in and liftable from said guiding slot, said beam having a free end which forms said first abutment projection, said guiding sleeve having an insertion end which forms said second abutment projection.

3. A saw as defined in claim 2; and further comprising a displacing sleeve arranged on said guiding sleeve; and a pressure spring, said beam being formed on said displacing sleeve, and said displacing sleeve being supported through said pressure spring on said guiding sleeve near an end of said guiding sleeve facing away from said insertion end.

4. A saw as defined in claim 3, wherein said guiding sleeve has a sleeve end facing away from said insertion end and having a radially projecting ring collar, said ring collar having a lower ring surface which faces said insertion end and forms a supporting surface for said pressure spring.

5. A saw as defined in claim 4, wherein said clamping screw has a screw shaft fixed on said motor housing and having a threaded portion arranged at least at a free end of said screw shaft, a wing nut screwed on said threaded portion, said guiding sleeve being arranged on said screw shaft; and further comprising a second pressure spring through which said wing nut abuts against said guiding sleeve.

6. A saw as defined in claim 5, wherein said guiding sleeve has a stepped opening with an opening portion provided in the region of said ring collar and having a greater diameter; and further comprising a further pressure spring which is located in said opening portion and coaxially surrounds said screw shaft.

7. A saw as defined in claim 5, wherein said screw shaft has an end which carries a flat head and also has a shaft portion following said flat head and having a rectangular cross-section; and further comprising a protective hood provided on said motor housing so as to cover at least partially said circular saw blade and having a housing wall with an opening provided with a rectangular cross-section corresponding to said rectangular cross-section of said shaft portion, so that said screw shaft extends with said shaft portion through said opening.

8. An electric motor operated hand circular saw, comprising a base plate; a motor housing turnable relative to said base plate; an electric motor accommodated in said motor housing and having a drive shaft; a circular saw blade arranged on said drive shaft of said electric motor; a pre-slitting abutment for adjusting a pre-slitting position of said saw blade in which said saw blade penetrates into a surface of a workpiece to be sawed by a limited pre-slitting depth, said pre-slitting abutment having two fixed abutment positions in which two different turning positions of said motor housing relative to said base plate are adjusted, so that in a first of said abutment positions during guiding said base plate over a guiding rail on a workpiece surface and in a second of said abutment positions during guiding said base plate along a strip clamped on the workpiece surface or with a parallel abutment held on said base plate on the workpiece edge on the workpiece surface, said saw blade penetrates correspondingly into the workpiece surface with a pre-slitting depth, said pre-slitting abutment having a cutting depth ruler mounted on said base plate and provided with a guiding slot extending over a turning region of said motor housing, and a clamping element fixed on said motor housing so that said clamping element extends through said guiding slot and is clampable on said cutting depth ruler; and a scale arranged along said guiding slot of said cutting depth ruler for a cutting depth adjustment of said saw blade, said clamping element having a beam provided with an adjusting mark cooperating with said scale.

9. A saw as defined in claim 8, wherein said clamping element has a guiding sleeve provided with a displacing sleeve on which said beam is formed.

10. An electric motor operated hand circular saw, comprising a base plate; a motor housing turnable relative to said base plate; an electric motor accommodated in said motor housing and having a drive shaft; a circular saw blade arranged on said drive shaft of said electric motor; and a pre-slitting abutment for adjusting a pre-slitting position of said saw blade in which said saw blade penetrates into a surface of a workpiece to be sawed by a limited minimum pre-slitting depth, said pre-slitting abutment having two abutment projections each defining a fixed abutment positions in which two fixed different turning positions of said motor housing relative to said base plate are adjusted, so that in a first of said abutment positions during guiding said base plate over a guiding rail on a workpiece surface and in a second of said abutment positions during guiding said base plate along a strip clamped on the workpiece surface or with a parallel abutment held on said base plate on the workpiece edge on the workpiece surface, said saw blade penetrates correspondingly into the workpiece surface with a pre-slitting depth.

11. An electric motor operated hand circular saw, comprising a base plate; a motor housing turnable relative to said base plate; an electric motor accommodated in said motor housing and having a drive shaft; a circular saw blade arranged on said drive shaft of said electric motor; and a pre-slitting abutment for adjusting a pre-slitting position of said saw blade in which said saw blade penetrates into a surface of a workpiece to be sawed by a limited pre-slitting depth, said pre-slitting abutment having two abutment projections which define two fixed abutment positions in which two different turning positions of said motor housing relative to said base plate are adjusted, so that in a first of said abutment positions during guiding said base plate over a guiding rail on a workpiece surface and in a second of said abutment positions during guiding said base plate along a strip clamped on the workpiece surface or with a parallel abutment held on said base plate on the workpiece edge on the workpiece surface, said saw blade penetrates correspondingly into the workpiece surface with a pre-slitting depth.

12. A saw as defined in claim 1, wherein said pre-slitting abutment has a cutting depth ruler mounted on said base plate and provided with a guiding slot extending over a turning region of said motor housing, and a clamping element fixed on said motor housing so that said clamping element extends through said guiding slot and is clampable on said cutting depth ruler.

13. A saw as defined in claim 12; and further comprising a scale arranged along said guiding slot of said cutting depth ruler for a cutting depth adjustment of said saw blade.

* * * * *